US007174944B1

(12) United States Patent
Clark et al.

(10) Patent No.: US 7,174,944 B1
(45) Date of Patent: Feb. 13, 2007

(54) TRIPLE SLIDE ASSEMBLY FOR SLIDING DOORS

(75) Inventors: Mike Clark, Alta Loma, CA (US); Mike Guidos, Alta Loma, CA (US)

(73) Assignee: Shower Enclosures, Inc., Ontario, CA (US)

( * ) Notice: Subject to any disclaimer, the term of this patent is extended or adjusted under 35 U.S.C. 154(b) by 295 days.

(21) Appl. No.: 10/864,305

(22) Filed: Jun. 8, 2004

Related U.S. Application Data

(60) Provisional application No. 60/478,072, filed on Jun. 11, 2003.

(51) Int. Cl.
*E05D 15/06* (2006.01)
*E06B 7/16* (2006.01)

(52) U.S. Cl. ..... 160/197; 16/96 R; 49/424

(58) Field of Classification Search ..... 160/184, 160/186, 197, 200, 202, 205, 222, 223, 196.1, 160/181, 201, 214; 16/94 R, 96 R, 95 R, 16/99, 105, 87, 87.4 R; 49/424, 425, 130, 49/366, 168, 409, 404, 116, 118, 117
See application file for complete search history.

(56) References Cited

U.S. PATENT DOCUMENTS

| | | | | |
|---|---|---|---|---|
| 3,100,916 | A | 8/1963 | McKinney | |
| 3,120,683 | A * | 2/1964 | Harris | 49/125 |
| 3,461,466 | A | 8/1969 | Weaver et al. | |
| 3,693,293 | A * | 9/1972 | Egan et al. | 49/56 |
| 3,896,508 | A * | 7/1975 | Doan | 4/557 |
| 3,911,991 | A * | 10/1975 | Malferrari | 160/202 |
| 4,014,070 | A | 3/1977 | Rifkin | |
| 4,090,265 | A * | 5/1978 | Baus | 4/607 |
| 4,192,100 | A * | 3/1980 | Klema | 49/404 |
| 4,221,255 | A * | 9/1980 | Barkemeyer | 160/197 |
| 4,258,443 | A | 3/1981 | Baus | |
| 4,268,996 | A | 5/1981 | Allen | |
| 4,350,399 | A * | 9/1982 | Berton et al. | 312/297 |
| 4,606,081 | A | 8/1986 | Baus | |
| 4,635,699 | A * | 1/1987 | Kauffman et al. | 160/211 |
| 4,785,485 | A * | 11/1988 | Etesam | 4/557 |
| 4,987,638 | A | 1/1991 | Ribaudo | |
| 4,991,257 | A | 2/1991 | Eutebach | |
| 5,046,791 | A | 9/1991 | Kooiman | |
| 5,657,581 | A | 8/1997 | Husting | |
| 5,895,101 | A | 4/1999 | Cabrales et al. | |
| 6,003,201 | A | 12/1999 | Ryczek | |
| 6,017,105 | A | 1/2000 | Goughnour et al. | |

(Continued)

*Primary Examiner*—Hugh B. Thompson, II
*Assistant Examiner*—Candace L. Bradford
(74) *Attorney, Agent, or Firm*—John P. O'Banion

(57) ABSTRACT

A triple slide assembly for a three panel door system that mounts on a two track header and allows the panels to slide easily and sequentially with an interlocking function that provides a means to align the panels. The outer rails or panels each have an inward facing track to support rollers mounted to the middle rail or panel in an alternating configuration. The track and roller assembly interlocks the three panels and has stops, positioned in the ends of the inward facing tracks, keep the panels interlocked. The inward facing tracks and middle rail or panel remain aligned with the header when the outer panels are adjusted to align with adjacent door jambs to provide a smooth sliding operation. The triple slide assembly can be used for a six-door, center opening enclosure and for a five panel sliding assembly mounted on a three track header.

26 Claims, 7 Drawing Sheets

U.S. PATENT DOCUMENTS 6,018,915 A * 2/2000 Pomish et al. ..... 52/64
6,860,311 B1 * 3/2005 Minor ..... 160/202
6,892,783 B1 * 5/2005 Comeau et al. ..... 160/126
6,923,238 B2 * 8/2005 Kern et al. ..... 160/197
2002/0053166 A1 5/2002 Fries
2004/0083653 A1 5/2004 Delgado et al.

* cited by examiner

TRIPLE SLIDE ASSEMBLY FOR SLIDING DOORS

CROSS-REFERENCE TO RELATED APPLICATIONS

This application claims priority from U.S. provisional application Ser. No. 60/478,072 filed on Jun. 11, 2003, incorporated herein by reference in its entirety.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND OF THE INVENTION

1. Field of the Invention

This invention pertains generally to track mechanisms for sliding doors, and more particularly to a track mechanism for a tri-panel door assembly that uses a header with two tracks and has an interlocking function that allows the movement of an outer door to guide the middle door with a smooth sliding operation.

2. Description of Related Art

There are many applications for sliding panels or doors to an enclosure, and the use of two sliding doors allows access to one side of an enclosure at a time. Two sliding doors on an enclosure can provide an access opening up to about 50 percent of the enclosure opening or about the width of one door.

Tri-panel sliding doors are used to provide a larger access opening to an enclosure. Three sliding glass doors can provide an access opening up to about 66 percent of an enclosure opening or about the width of two doors.

In many applications an interlock device is used to keep the doors from sliding past each other and damaging handles racks, etc., attached to the doors. In conventional sliding panel assemblies, an interlocking function is achieved by overlapping the door stiles to provide the drawing mechanism. In other conventional systems, an interlocking protrusion or stop is installed on the stile of adjacent doors. However, the sliding operation is less than desirable with these devices.

Furthermore, the header of a conventional tri-panel door system requires three independent tracks, one for each door, to allow the doors to slide without interference or misalignment. This arrangement requires a wider, more expensive header and can also reduce the available area of a small enclosure. A three track header adds to the complexity of aligning each door with the adjacent jambs, aligning three doors with respect to each other, and interlocking the three doors.

Therefore, there is a need for a triple slide assembly with an interlocking function that allows the panels to slide easily, align easily and which does not require a wider, more expensive, three track header.

BRIEF SUMMARY OF THE INVENTION

The invention is a triple slide assembly for a three panel door system that mounts on a two track header and allows the panels to slide easily and sequentially with an interlocking function that provides a means to align the panels. Outer rails or panels each have an inward facing track to support rollers mounted to the middle rail or panel in an alternating configuration. The track and roller assembly interlocks the three panels and has stops, positioned in the ends of the inward facing tracks, to keep the panels interlocked. The inward facing tracks and middle rail or panel remain aligned with the header when the outer panels are adjusted to align with adjacent door jambs to provide a smooth sliding operation.

One embodiment of the invention is a triple slide assembly for sliding doors, having first and second track members, first and second rail members attached to the first and second track members respectively, a third rail member slidably supported by the first and second track members, where the rail members are adapted to receive an upper edge of a sliding door panel, and the track and rail assembly is adapted to be slidably received by a header member.

An aspect of the invention is where the rail members interlock.

A further aspect of the invention is where movement of an outer door panel received by the first rail member will guide a center panel received by the third rail member in the direction of travel of the outer door panel.

A still further aspect of the invention is where the header member conceals interlocking of the rail members.

Another aspect of the invention is a triple slide assembly for sliding doors, comprising a header member, a first rail member adapted to slidably engage the header member, a second rail member adapted to slidably engage the header member, and a third rail member adapted to slidably engage the first and second rail members, where the first and second and third rail members are each adapted to receive an upper edge of a sliding door panel.

A still further aspect of the invention is a triple slide assembly for sliding doors that comprises first and second track members, first, second and third rail members, where each rail member is adapted to receive an upper edge of a sliding door panel, and means for slidably coupling the track and rail members as an assembly adapted to be slidaby received by a header member, where the door panels received by the rail members interlock Another aspect of the invention is a slide assembly for three sliding panels adapted to couple to a header having first and second header tracks that comprises first and second rail members adapted to slidingly couple to the first and second header tracks respectively, first and second track members adapted to couple to the first and second rail members respectively, a third rail member adapted to slidingly couple to the first and second track members, and where the third rail member is supported by the first and second track members.

A further aspect of the invention is where the first and second rail members are adapted to slidingly couple to the first and second header tracks with rollers.

A yet further aspect of the invention is where the third rail member is adapted to slidingly couple to the first and second track members with rollers.

Another aspect of the invention further comprises a plurality of stops coupled to the first and second track members, where the stops are positioned to guide the third rail member in the direction of movement of the first rail member or the second rail member.

A further aspect of the invention is where the first, the second and the third rail members support a door panel.

A still further aspect of the invention is where the alignment of the first and second rail members relative to the header is adjustable.

Another aspect of the invention is where the third rail member remains aligned with the header when the alignment of the first or the second rail members is adjusted.

A further aspect of the invention is where the first and second track members remain aligned with the header when the alignment of the first or the second rail members is adjusted.

A still further aspect of the invention is where the first and the second track members have a C shape cross section.

Another aspect of the invention is where the first and the second track members are straight.

Another embodiment of the invention is a slide door mechanism adapted to couple to a header member having first and second header tracks comprising first, second and third panels having an upper edge, first sliding means for slidably coupling the upper edge of the first and second panels to the first and second header tracks, second sliding means for slidably coupling the upper edge of said third panel, to the upper edge of the first and second panels, and where the third panel is supported by the first and second panels through the second sliding means.

Another aspect of the invention is interlocking means coupled to the first and second panels, where the interlocking means is configured to guide the third panel in the direction of movement of the first panel in response to movement of the first panel, and where the interlocking means is further configured to guide the third panel in the direction of movement of the second panel in response to movement of the second panel.

A further aspect of the invention is where the interlocking means is a plurality of stops mounted in the first and second track members.

A still further aspect of the invention is where the interlocking means is a plurality of overlapping protrusions coupled to the first, the second and the third panels.

A yet further aspect of the invention is where the upper edge of the first and second panels are concealed by the header.

Another aspect of the invention is where the first sliding means comprises a sliding member selected from the group consisting essentially of a roller, a bearing and a plastic slide.

A further aspect of the invention is where the second sliding means comprises a sliding member selected from the group consisting essentially of a roller, a bearing and a plastic slide.

A still further aspect of the invention is where the upper edges of the first panel, the second panel and the third panel comprise a rail.

Another embodiment of the invention is a slide door mechanism further comprising a fourth and fifth panels having an upper edge, where the fourth panel is adapted to couple to the first header track with the first sliding means, where the fifth panel is adapted to couple to the second header track with the first sliding means, third and fourth track members adapted to couple to the upper edge of the fourth and fifth panels respectively, a sixth panel, the sixth panel having an upper edge adapted to couple to the second sliding means, and where the sixth panel is supported by the third and fourth track members through the second sliding means.

Another aspect of the invention is a three door slide assembly comprising a header configured with first and second header tracks, first and second rail members adapted to slidingly couple to the first and second header tracks, first and second track members adapted to couple to the first and second rail members respectively, a third rail member adapted to slidingly couple to the first and the second track members, and where the third rail member is supported by the first and the second track members.

A further aspect of the invention is where the first and second rail members are interlocked to the third rail member by a plurality of stops mounted in the first and the second track members, and where movement of the first or the second rail member guides the movement of the third rail member.

A still further aspect of the invention is where the first, the second and the third rails members support a first, a second and a third door panel respectively.

Another aspect of the invention is where the first and the second door panels are interlocked to the third door panel by a plurality of overlapping protrusions mounted to the first and the second door panels, and where the first and the second door panels are further interlocked to the third door panel by a plurality of stops mounted to the first and the second track members.

A further aspect of the invention is where the first and the second door panels are interlocked to the third door panel by a plurality overlapping protrusions mounted to the first, the second and the third door panel.

A still further aspect of the invention is where the first and second track members are recessed in the first and the second door panels respectively.

Another aspect of the invention is where the alignment of the first and second rail members relative to the header is adjustable.

A further aspect of the invention is where the alignment of the third panel relative to the header remains fixed when alignment of the first or the second rail members is adjusted.

A yet further aspect of the invention is where the alignment of the first and second track members relative to the header remains fixed when alignment of the first or the second rail members is adjusted.

Another aspect of the invention is where the header is straight, and where the first and the second track members are straight.

Another embodiment of the invention is a center opening slide panel assembly adapted to couple to a header with a first track and a second track comprising a first panel member adapted to slidingly couple to the first header track, a first track member coupled to the first panel member, a second panel member adapted to slidingly couple to the second header track, a second track member coupled to the second panel member, a first middle panel member adapted to slidingly couple to the first track member and the second track member, where the first middle panel member is interlocked with the first panel member and the second panel member, a third panel member adapted to slidingly couple to the first header track, a third track member coupled to the third panel member, a fourth panel member adapted to slidingly couple to the second header track, a fourth track member coupled to the fourth panel member, a second middle panel member adapted to slidingly couple to the third track member and the fourth track member, where the second middle panel member is interlocked with the third panel member and the fourth panel member.

Another aspect of the invention is a plurality of stops mounted in the first, second, third and fourth track members, where the stops interlock the first middle panel member to the first and second panel member, and where the stops interlock the second middle panel member to the third and fourth panel member.

A further aspect of the invention is a plurality of protrusions mounted on the first, second, third and fourth panel members, where the protrusions interlock the first middle panel member to the first and second panel member, and where the protrusions interlock the second middle panel member to the third and fourth panel member.

A still further aspect of the invention is where alignment of the first, second, third and fourth panel members is adjustable relative to the header.

Another aspect of the invention is where alignment of the first middle panel member with the header remains fixed when the alignment of the first or second panel member is adjusted, and alignment of the second middle panel member with the header remains fixed when the alignment of the third or fourth panel member is adjusted.

Yet another aspect of the invention is a slide rail assembly adapted to couple to a header with a first track a second track and a third track comprising a first rail member adapted to slidingly couple to the first header track, a first track member coupled to said first rail member, a second rail member adapted to slidingly couple to the second header track, a second track member coupled to said second rail member, a third rail member adapted to slidingly couple to said first track member and said second track member, wherein said third rail member is interlocked with said first rail member and said second rail member, a third track member coupled to said second rail member, a fourth rail member adapted to slidingly couple to the third header track, a fourth track member coupled to said third rail member; and a fifth rail member adapted to slidingly couple to said third track member and said fourth track member; wherein said fifth rail member is interlocked with said third rail member and said fourth rail member.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Referring more specifically to the drawings, for illustrative purposes the present invention is embodied in the apparatus generally shown in FIG. 1 through FIG. 7. It will be appreciated that the apparatus may vary as to configuration and as to details of the parts, and that the method may vary as to the specific steps and sequence, without departing from the basic concepts as disclosed herein.

Figure 1:
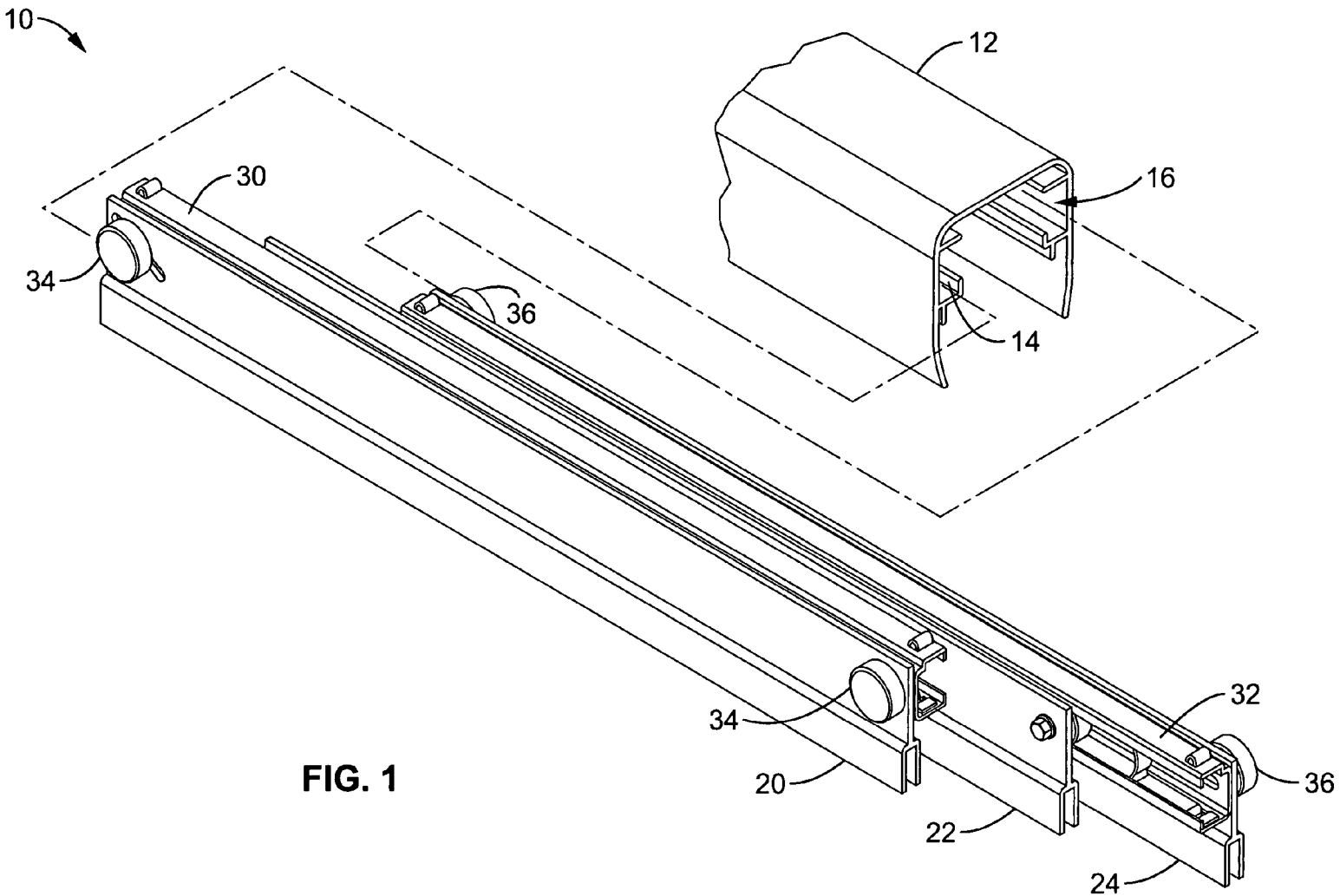
FIG. 1 is an assembled perspective view of a triple slide assembly according to the present invention with the rail and track portion shown in a partially extended position and shown separated from the header portion.

FIG. 1 illustrates an assembled perspective view of a triple slide assembly 10 according to the invention. In FIG. 1, a two track header 12 is shown in cut away view as the support for the triple slide assembly 10 with front header track 14 and rear header track 16 in the walls of header 12. Three slider rails, front rail 20, middle rail 22 and rear rail 24 are shown interlocked together. Front rail 20 has front track 30 facing middle rail 22 and rear rail 24 has rear track 32 facing middle rail 22. Middle rail 22 is interconnected with rails 20, 24 through front track 30 and rear track 32. Front rollers 34 support front rail 20 in header track 14 and rear rollers 36 support rear rail 24 in header track 16.

Figure 2:
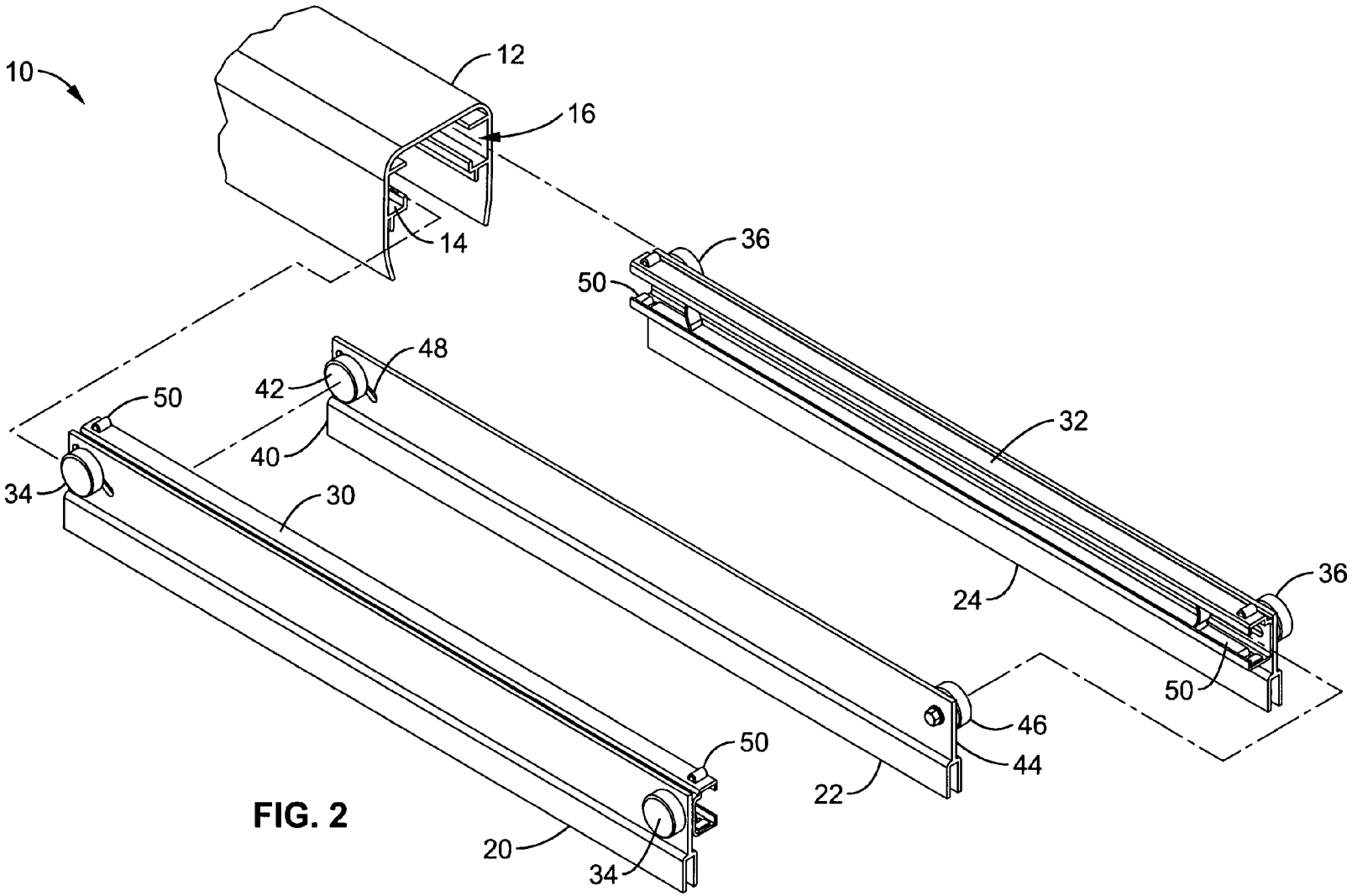
FIG. 2 is a partially exploded view of the triple slide assembly shown in FIG. 1.

FIG. 2 illustrates a partially exploded view of triple slide assembly 10 shown in FIG. 1. Referring to FIG. 2, middle rail 22 has left end 40 with a middle front roller 42 aligned with front track 30 and a right end 44 with a middle rear roller 46 aligned with rear track 34. Middle front roller 42 rides in front track 30 attached to front rail 20. Middle rear roller 46 rides in rear track 32 attached to rear rail 24. In this configuration, middle rail 22 is supported on left end 40 by front rail 20 through track 30 and roller 42 and on the right end 44 by rear rail 24 through track 32 and roller 46. This configuration of alternating rollers on front and rear tracks provides two direction movement of the middle rail 22 and couples front, rear tracks 30, 32 to middle rail 22 to allow simultaneous gliding, interlocking and adjustability. Angled slot 48 is provided for adjustment of middle rail 22 in relation to header 12. In one embodiment, tracks 30, 32 and all the rollers are concealed within header 12. In another embodiment, the width of header 12 is approximately 2.5 inches. This is in contrast to conventional three panel slide systems where a triple track header for the same application is about 3.25 inches. In a further contemplated embodiment, header 12 has one or both header tracks 14, 16 positioned facing the same direction or positioned on the exterior of header 12.

Removable, spring-loaded stop clips 50 are shown positioned in each end of tracks 30, 32 to keep the panels interlocked and prevent rollers 42, 46 from rolling past the ends of tracks 30, 32. In other, less preferable modes, plugs, screws or pins are used as stops.

Figure 3:
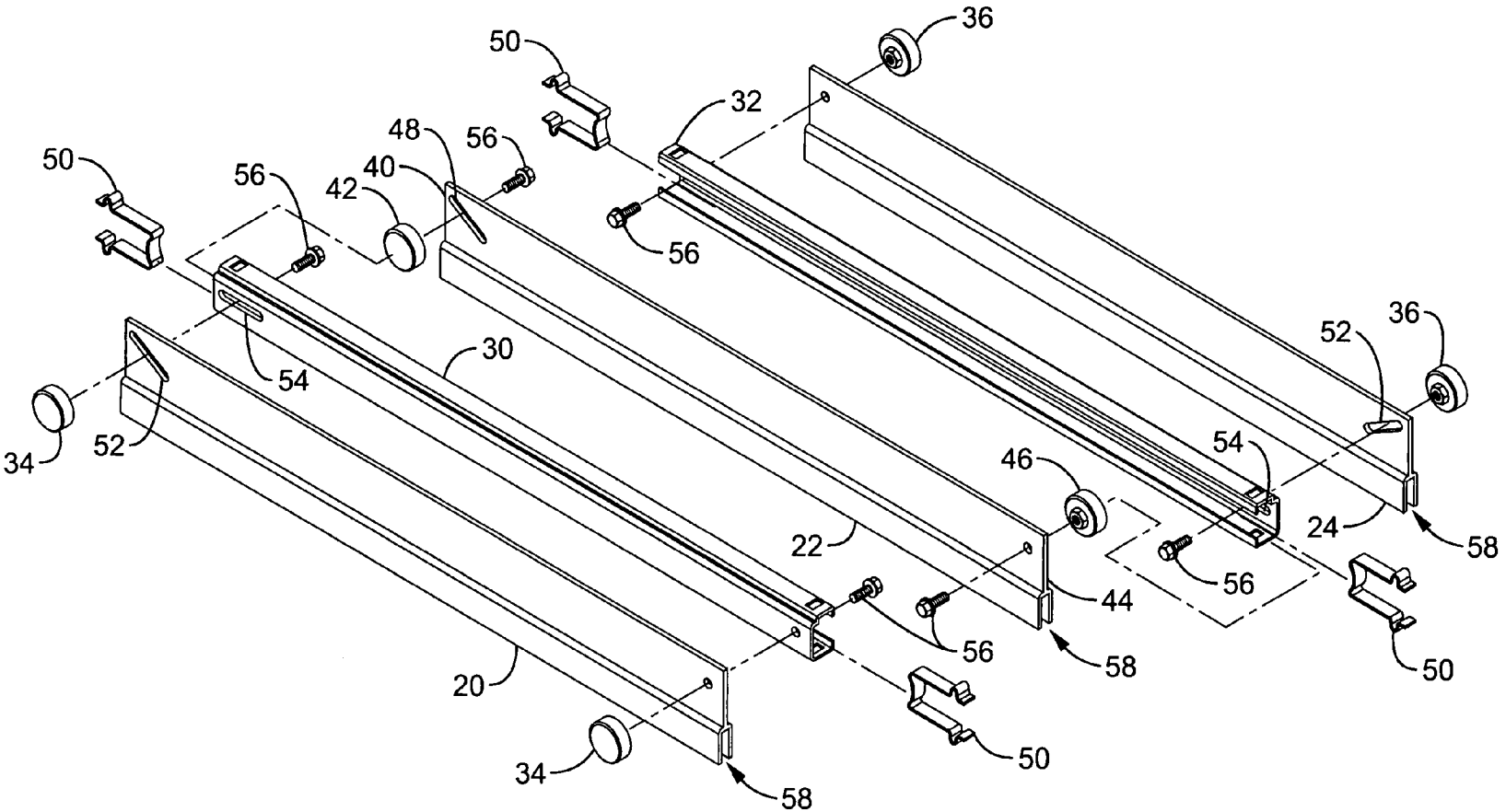
FIG. 3 is an exploded view of the track and rail portion of the triple slide assembly shown in FIG. 1 and FIG. 2.

FIG. 3 is an exploded view of the track and rail portion of the triple slide assembly 10 shown in FIG. 1 and FIG. 2. Front and rear rails 20, 24 each have an angled adjustment slot 52 at one end to allow for fine adjustments and alignment of front, rear rail 20, 24 on header rollers 34, 36 and relative to header 12 to create a flush application between panels supported by rails 20, 24 and the adjacent jambs or walls. In one mode, slots 52 have an angle of about 30 degrees. Tracks 30 and 32 have horizontal slots 54 at one end that align with adjustment slots 52. As rails 20, 24 are aligned with adjacent walls or jambs, tracks 30, 32 and middle rail 22 remains aligned with the header, thereby eliminating contradicting angles between tracks 30, 32 and allowing for smooth sliding operation of middle rail 22. Alignment of middle rail 22 with header 12 (see FIG. 2) or adjacent rails 20, 24 can be adjusted separately with roller 42 in adjustment slot 48.

In a highly beneficial mode, hex screws 56 are used to attach tracks 30, 32 to rails 20, 24 and to attach rollers 34, 36, 42 and 46. Hex screws 56 are also used to secure the alignment of rails 20, 24 in adjustment slots 52, 54 and alignment of middle rail 22 in adjustment slot 48. Other fasteners as are known in the art are used in other modes. Once rollers 34, 36 are supported in header tracks 14, 16 in header 12 (see FIG. 1), and rollers 42, 46 are supported in tracks 30, 32, assembly 10 nests together as shown previously in FIG. 1. Stops 50 are inserted in each end of tracks 30, 32 to keep the assembly interlocked and from separating during use. Stops 50 also guide middle rail 22 in the direction of movement of front rail 20 or rear rail 24

FIG. 3 illustrates one preferred mode where rails 20, 22, 24 are configured with slots 58 to support panels such as glass or plastic shower doors, mirrors or panels such as for a closet or a display cupboard. In another preferred mode (not shown), rails 20, 22 and 24 are adapted to support door panels such as for walk in closets, pocket doors or room partitions. In a still further mode (not shown), rails 20, 22 and/or 24 are configured for movement by piston, motor, chain drive or other remote or automated means. Tracks 30, 32 are illustrated with a preferable "C" cross section as an anti-jump feature to keep rollers 42, 46 positively locked in tracks 30, 32. In another mode (not shown), tracks 30, 32 have a "J" cross section and rollers 42, 46 with middle rail 22 can be lifted up and out of J tracks 30, 32. In a further mode, rollers 42, 46 are configured in tandem trucks to ride on top and bottom of a track with a "J" cross section as an anti-jump feature. In a still further mode, tracks 30, 32 are configured as an "H" and rollers 42, 46 are configured in tandem trucks to ride on top and bottom of a track with an "H" cross section as an anti-jump feature. It is to be appreciated that the header and triple slide assembly shown in FIG. 1 through FIG. 3 can be configured for curved openings, for example a quarter round shower door opening, in accordance with the invention. In a curved configuration, each rail and track is positioned on the circumference of a circle projected from a common center point.

Figure 4:
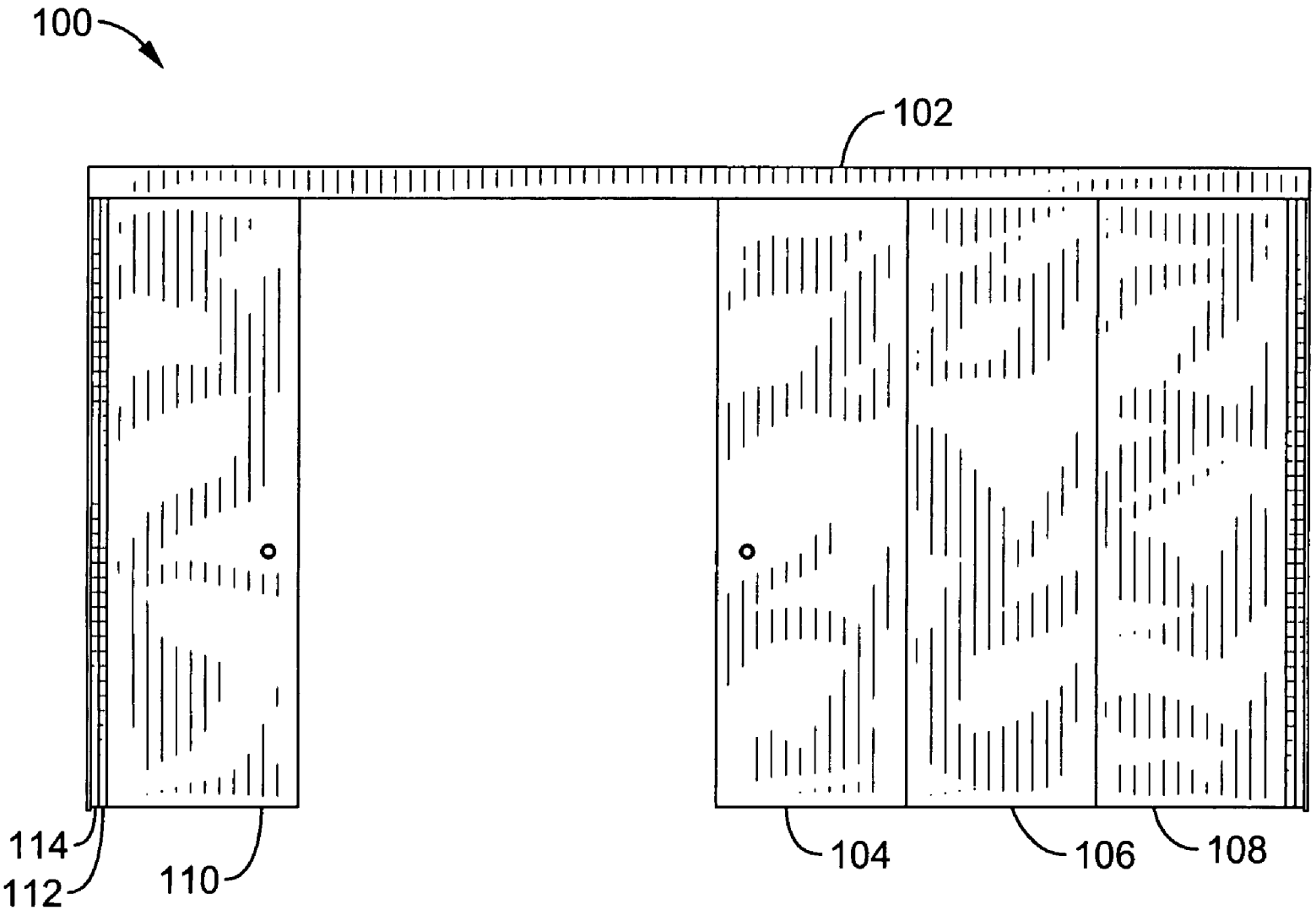
FIG. 4 is a front view of two, triple slide doors on a two track header and configured to open in the center according to the present invention.

FIG. 4 illustrates an elevation view of an embodiment of the invention with opposing triple slide panels, generally designated 100, that provide center access to an enclosure opening. Details of the triple slide assembly as previously described in FIG. 1 through FIG. 3 are omitted for clarity. Two track header 102 defines an enclosure and right panels 104, 106 and 108 are positioned on header 102 where front panel 104 is supported by a front header track and rear panel 108 is supported by a rear header track as shown previously in FIG. 1 and FIG. 2. Middle panel 106 is supported by panels 104 and 108 as shown previously in FIG. 1 through FIG. 3. Left panel doors 110, 112 and 114 are similarly positioned on header 102 with front panel 110 supported on the front header track and rear panel 114 supported on the rear header track. Front panel 110 is shown in an open configuration and can slide open to about the position of rear panel 114 positioned against the left jamb. In this center open position, the center access opening can be up to about two thirds of the full enclosure opening. Panels 108 and 114 are configured to slide towards the center to provide an access opening to each end of the enclosure. Note that the panels can be positioned all on one side to provide a side access opening of up to about two thirds of the enclosure opening.

In one mode, this configuration provides access to a display area such as a stage, vignette, bulletin board or white board. In another mode, this configuration provides access to a centrally positioned audio visual screen, such as a TV or projection screen, positioned behind panels 104, 106, 110 and 112 and access to equipment or media storage positioned behind panels 108 and 114. In a further mode, a wardrobe is configured with a clothes rod behind panels 104, 106, 110 and 112 and shelves or drawers behind panels 108 and 114. In a still further mode (not shown), center opening triple slide assembly 100 is configured as a double pocket door with panels 108 and 114 configured to slide into the side door pockets. Additional modes of this embodiment, such as for room dividers, privacy screens, cabinets, cupboards or pantries, are contemplated. Center opening triple slide assembly 100 can also be configured for a curved enclosure opening such as a stage or display area (not shown).

Although the panels in FIG. 4 are illustrated to all be about the same width, slide assemblies with panels or rails of different widths (not shown) are contemplated for particular applications.

Figure 5:
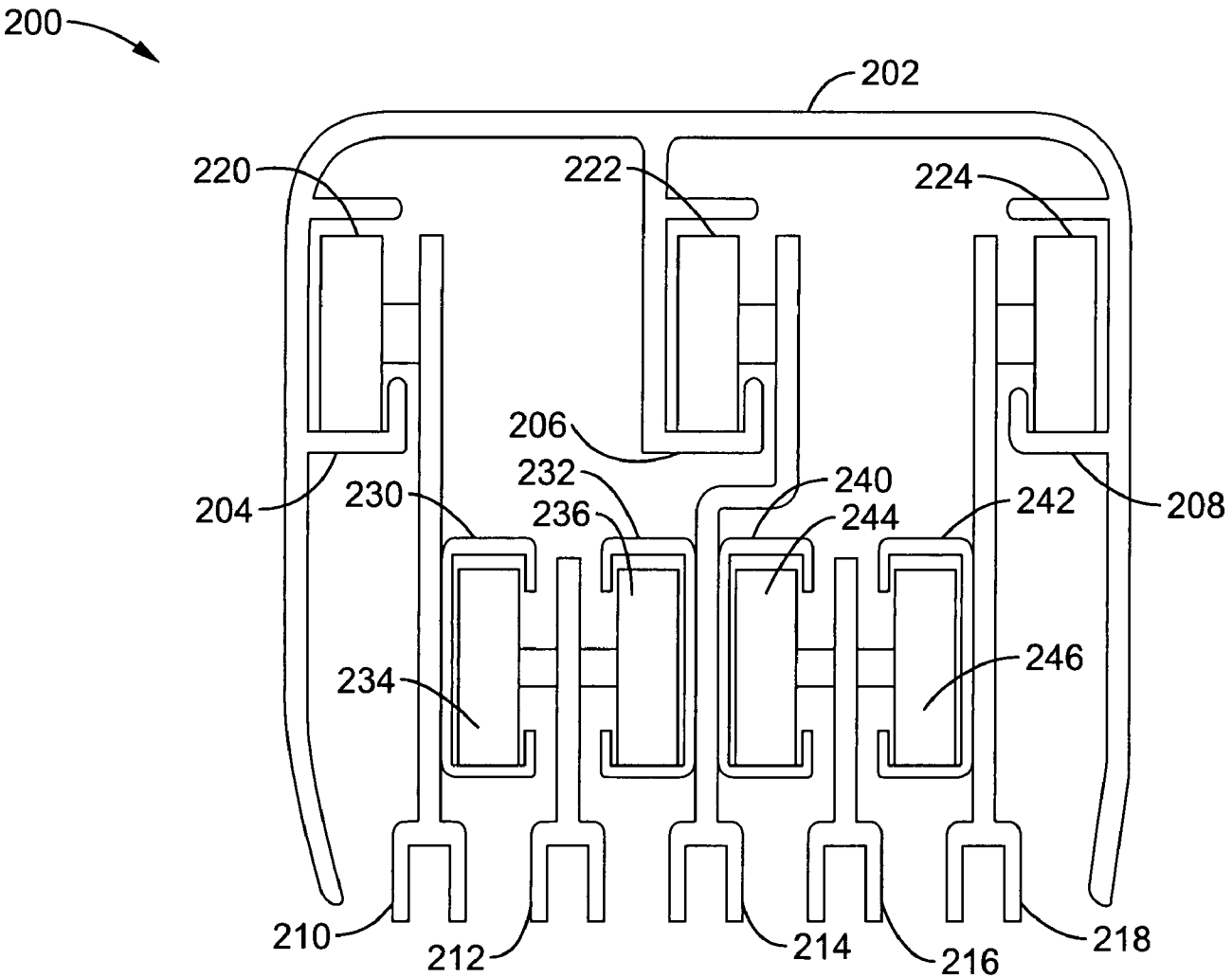
FIG. 5 is a cross section view of a three track header supporting a five rail, interlocked slide assembly, according to the present invention.

FIG. 5 illustrates a cross section view of a triple track header and five slider panels, generally designated as 200, and in accordance with the present invention. In this illustration, left is the front of the assembly unless otherwise specified. Triple track header 202, such as is used with conventional three slide panel systems, has front header track 204, middle header track 206 and rear header track 208. Five rails are shown in the assembly and are designated left to right, first rail 210, second rail 212, third rail 214, fourth rail 216 and fifth rail 218. First rail 210 is supported on front header track 204 by header roller 220, third rail 214 is supported on middle header track 206 by header roller 222 and fifth rail 218 is supported on rear header track 208 by header roller 224. First rail 210 has first inner track 230 facing third rail 214 and third rail 214 has second inner track 232 facing first inner track 230. Rail 212 is supported by first roller 234 in first track 230 and second roller 236 in second track 232 configured as previously described in FIG. 1 through FIG. 3. Rail 214 further has third inner track 240 facing fifth rail 218 and fifth rail 218 has a fourth inner track 242 facing third inner track 240. Fourth rail 216 is supported by third roller 244 in third track 240 and by fourth roller 246 in fourth track 242. In this configuration, each rail is interlocked with the adjacent rail as shown previously in FIG. 3. In one mode, stops (not shown) are positioned at each end of track 230, 232, 240, 242 to interlock the rails and guide the inner rails as shown previously in FIG. 3. Sliding all the rails to one side can provide an access opening up to a maximum of about 80% of an enclosure opening as compared to a maximum of about 66% for conventional triple side assemblies on a triple track header.

In one beneficial mode, this embodiment is contemplated for room partitions or pocket doors. In another mode, this embodiment is contemplated to provide a larger access opening to enclosures such as showers or rooms, or to accommodate wider access opening requirements, such as individuals with wheel chairs or walking aids. In a further mode, this embodiment provides a wider access opening to a restricted enclosure opening such as a cupboard, wardrobe or shower enclosure in an RV.

Figure 6:
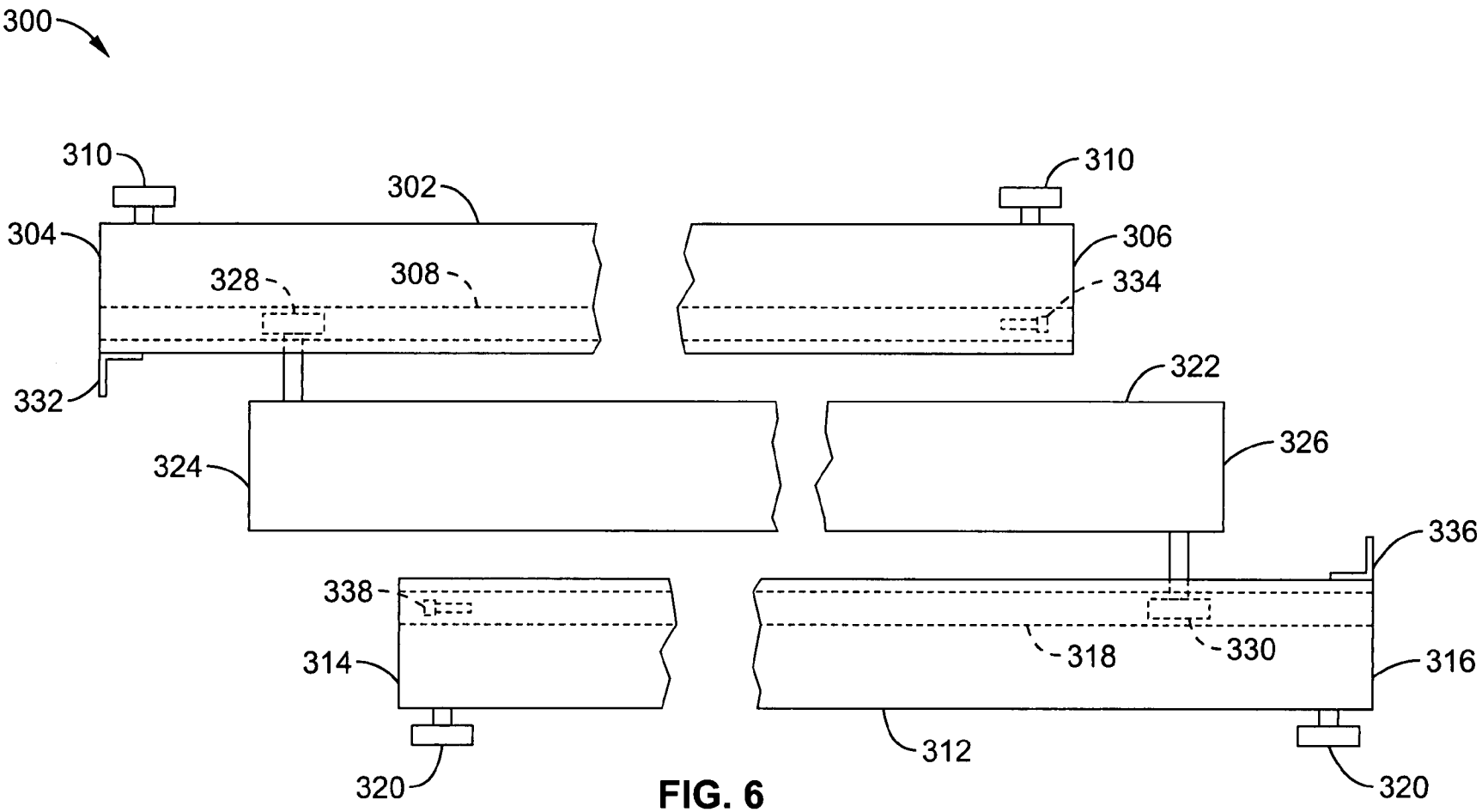
FIG. 6 is a schematic plan view of a three panel slide assembly with one stop in each track and stile protrusions on the outer panels according to the present invention.

FIG. 6 illustrates a schematic plan view of an embodiment of a triple slide assembly 300 for door panels. Details of roller hangers and associated hardware are omitted for clarity. Front panel 302 has left edge 304 and right edge 306. Front track 308 (shown in phantom for clarity) is shown recessed into panel 302 near the top edge. Header rollers 310 are positioned to mate with a front track of a two track header (as shown previously in FIG. 1) Note that header rollers 310 may be mounted on a hanger or bracket near the centerline of the top edge of front panel 302 but are shown extended to the side for clarity. In this embodiment, the alignment of header roller 310 near left edge 304 is adjustable relative to panel 302 and interlocked with the left end of front track 308 as described previously in FIG. 3, but not shown here for clarity. Rear panel 312 has left edge 314 and right edge 316. Rear track 318 (shown in phantom) is recessed into panel 312 near the top edge. Header rollers 320 are positioned to mate with a rear track of a two track header (as shown previously in FIG. 1). In this embodiment, the alignment of header roller 320 near right edge 316 is adjustable relative to panel 312 and interlocked with the right end of rear track 318 as described previously in FIG. 3. Middle panel 322 has left edge 324 and right edge 326. Front roller 328 is positioned near left edge 324 and mates to front track 308. Rear roller 330 is positioned near right edge 326 and mates to rear track 318.

In this embodiment, a protrusion (or handle) 332 is positioned on left edge 304 of front panel 302 and aligned to contact the left edge 324 of middle panel 322. A stop 334 is positioned near the right edge 306 in front track 308. Protrusion 332 eliminates a need for a stop near the left edge 304 of front track 308. Similarly, a protrusion 336 is positioned near the right edge 316 of panel 312 and aligned to contact middle panel 332 at right edge 326. A stop 338 is positioned near the left edge 314 in rear track 318. Protrusion 336 eliminates a need for a stop near right edge 316 of rear track 318.

Figure 7:
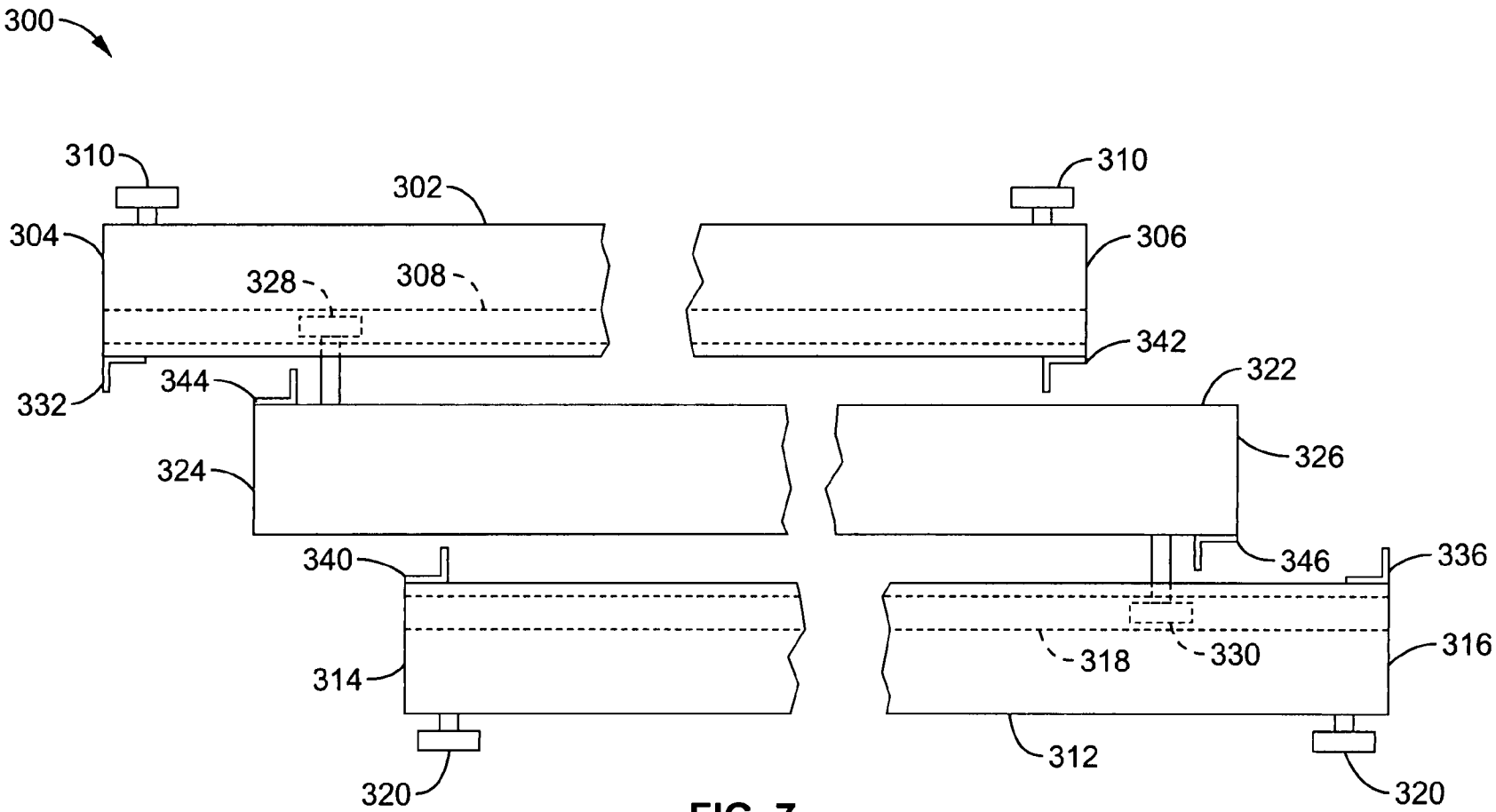
FIG. 7 is a schematic plan view of the three panel slide assembly shown in FIG. 6 with no stops in the tracks and six stile protrusions.

FIG. 7 illustrates the triple slide assembly 300 for door panels shown in FIG. 6 with no stops positioned in front track 308 or rear track 318. A protrusion 340 is positioned near the left end 314 of rear panel 312 and facing middle panel 322. Another protrusion 342 is positioned near right end 306 of front panel 302 and facing middle panel 322. A protrusion 344 configured to contact protrusion 342 is positioned on the left edge of middle panel 322 facing front panel 302. This configuration of protrusions keeps front roller 328 in front track 308 and front panel 302 interlocked with middle panel 322. Similarly, a protrusion 346 is positioned near right end 306 of front panel 302, facing middle panel 322 and configured to contact protrusion 340. This configuration of mating protrusions keeps rear roller 330 in rear track 318 and rear panel 312 interlocked with middle panel 322. In one mode, protrusions 340, 342, 344, or 346 are configured as vertical gaskets for insulation, infiltration or as splash guards for a shower door enclosure.

In a further embodiment (not shown), protrusions 344, 346 are pins that mate with aligned closed end grooves (not shown) in adjacent panels to limit the travel of the middle panel and eliminate a need for protrusions 332, 342, 336 and 340 and for stops in tracks 308, 318. In another embodiment (not shown), stops in tracks 308, 318 are replaced by chains, cords, bands or other interlocking means connected between front panel 302 and middle panel 322 and between rear panel 312 and middle panel 322. In a still further contemplated embodiment (not shown), magnets oriented with opposing fields are attached to the edges of the panels to provide an interlocking force between adjacent panels without stops in the tracks or protrusions.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A slide assembly for three sliding panels adapted to couple to a header having first and second header tracks comprising:

first and second rail members adapted to slidingly couple to the first and second header tracks respectively;

first and second track members adapted to couple to said first and second rail members respectively; and a third rail member adapted to slidingly couple to said first and second track members;

wherein said third rail member is supported by said first and second track members; and wherein said first and second track members remain aligned with the header when the alignment of said first or said second rail members is adjusted.

2. A slide assembly as recited in claim 1, further comprising a plurality of rollers, wherein said first and second rail members are adapted to slidingly couple to the first and second header tracks with said rollers.

3. A slide assembly as recited in claim 1, further comprising a plurality of rollers, wherein said third rail member is adapted to slidingly couple to said first and second track members with said rollers.

4. A slide assembly as recited in claim 1, further comprising:

a plurality of stops coupled to said first and second track members;

wherein said stops are positioned to limit movement of said third rail member to between said first rail member and said second rail member.

5. A slide assembly as recited in claim 1, wherein said first and second track members are positioned on said first and second rail to be concealed by a header.

6. A slide assembly as recited in claim 1, wherein stops positioned at the ends of said first and second track members interlock said first and second rail members with said third rail member.

7. A slide assembly as recited in claim 1, wherein said first, said second and said third rail members further support a door panel.

8. A slide assembly as recited in claim 1, wherein alignment of said first and second rail members relative to the header is adjustable.

9. A slide assembly as recited in claim 8, wherein said third rail member remains aligned with the header when the alignment of said first or said second rail members is adjusted.

10. A slide assembly as recited in claim 1, wherein said first and said second track members have a C shape cross section.

11. A slide assembly as recited in claim 1, wherein said first and said second track members are straight.

12. A three door slide assembly comprising:

a header configured with first and second header tracks;

first and second rail members adapted to slidingly couple to said first and second header tracks;

first and second track members adapted to couple to said first and second rail members respectively; and a third rail member adapted to slidingly couple to said first and said second track members;

wherein said third rail member is supported by said first and said second track members;

wherein said first, said second and said third rails members support a first, a second and a third door panel respectively; and wherein said first and second track members are recessed in said first and said second door panels respectively.

13. A slide assembly as recited in claim 12, wherein said first and second track members remain aligned with the header when the alignment of said first or said second rail members is adjusted.

14. A three door slide assembly as recited in claim 12:

wherein said first and second rail members are interlocked to said third rail member by a plurality of stops mounted in said first and said second track members; and wherein movement of said first or said second rail member guides movement of said third rail member.

15. A three door slide assembly as recited in claim 12:

wherein said first and said second door panels are interlocked to said third door panel by a plurality of overlapping protrusions mounted to said first and said second door panels; and wherein said first and said second door panels are further interlocked to said third door panel by a plurality of stops mounted to said first and said second track members.

16. A three door slide assembly as recited in claim 12, wherein said first and said second door panels are interlocked to said third door panel by a plurality of overlapping protrusions mounted to said first, said second and said third door panel.

17. A three door slide assembly as recited in claim 12, wherein the alignment of said first and second rail members relative to said header is adjustable.

18. A three door slide assembly as recited in claim 12, wherein the alignment of said third door panel relative to said header remains fixed when alignment of said first or said second rail members is adjusted.

19. A three door slide assembly, comprising:

a header configured with first and second header tracks;

first and second rail members adapted to slidingly couple to said first and second header tracks;

first and second track members adapted to couple to said first and second rail members respectively; and a third rail member adapted to slidingly couple to said first and said second track members;

wherein said third rail member is supported by said first and said second track members; and wherein the alignment of said first and second track members relative to said header remains fixed when alignment of said first or said second rail members is adjusted.

20. A three door slide assembly as recited in claim 19, wherein said first, said second and said third rails members support a first, a second and a third door panel respectively.

21. A three door slide assembly as recited in claim 19:

wherein said header is straight; and wherein said first and said second track members are straight.

22. A slide panel assembly adapted to couple to a header with a first track and a second track comprising:

a first panel member adapted to slidingly couple to the first header track;

a first track member coupled to said first panel member;

a second panel member adapted to slidingly couple to the second header track;

a second track member coupled to said second panel member;

a middle panel member adapted to slidingly couple to said first track member and said second track member;

wherein said first and second track members are recessed in said first and said second panels respectively.

23. A slide panel assembly as recited in claim 22, further comprising:

a plurality of stops mounted in said first, and second track members;

wherein said stops limit movement of said middle panel member to between said first and second panel member.

24. A slide panel assembly as recited in claim 22, further comprising:

a plurality of protrusions mounted on said first, and second panel members;

wherein said protrusions limit movement of said middle panel member to between said first and second panel member.

25. A slide panel assembly as recited in claim 22, wherein alignment of said first and second panel members is adjustable relative to the header.

26. A slide panel assembly as recited in claim 25, wherein alignment of said middle panel member with the header remains fixed when the alignment of said first or second panel member is adjusted.

* * * * *